US006981698B2

(12) United States Patent
Yamamiya et al.

(10) Patent No.: US 6,981,698 B2
(45) Date of Patent: Jan. 3, 2006

(54) AUTOMATIC DISPENSING MACHINE OF SUBSTANTIALLY FLAT GOODS

(75) Inventors: Takahito Yamamiya, Iwatsuki (JP); Akira Okuyama, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 138 days.

(21) Appl. No.: 10/384,972

(22) Filed: Mar. 10, 2003

(65) Prior Publication Data

US 2003/0197323 A1 Oct. 23, 2003

(30) Foreign Application Priority Data

Mar. 11, 2002 (JP) ..... 2002-064796
Feb. 6, 2003 (JP) ..... 2003-029006

(51) Int. Cl.
*B65H 5/00* (2006.01)

(52) U.S. Cl. ..... 271/10.01; 271/11; 271/12; 271/30.1; 271/147; 271/152

(58) Field of Classification Search ..... 271/10.01, 271/11, 12, 30.1, 147, 152
See application file for complete search history.

(56) References Cited

U.S. PATENT DOCUMENTS 4,796,061 A * 1/1989 Ikeda et al. ..... 355/73
4,930,763 A * 6/1990 Horii et al. ..... 271/31
5,180,156 A * 1/1993 Matsui et al. ..... 271/103
5,310,171 A * 5/1994 Honma et al. ..... 271/9.11
5,722,651 A * 3/1998 Pankhania ..... 271/13.19
6,102,248 A * 8/2000 Yamamiya ..... 221/211
6,168,151 B1 * 1/2001 Tsuchida ..... 271/126
6,311,867 B1 * 11/2001 Yamamiya ..... 221/217

FOREIGN PATENT DOCUMENTS

EP 0556794 * 8/1993

* cited by examiner

*Primary Examiner*—Donald P. Walsh
*Assistant Examiner*—Thomas Morrison

(57) ABSTRACT

An automatic dispensing machine of substantially flat goods is provided which detects the over-dispensing of goods while accommodating for varying thickness of the substantially flat goods. The automatic dispensing machine includes a table which supports goods such as cards, a suctioning device which pulls the cards, a transporting device which transports the cards after they are pulled by the suctioning device, a position-control device which controls the distance between the uppermost card and the suctioning device. The position-control device is configured to increase the distance between the uppermost card and the suctioning device based on a dispensing signal. The distance between the uppermost card and the suctioning device is then decreased until a predetermined distance is reached.

20 Claims, 8 Drawing Sheets

AUTOMATIC DISPENSING MACHINE OF SUBSTANTIALLY FLAT GOODS

CROSS-REFERENCE TO RELATED APPLICATIONS

This non-provisional United States (U.S.) patent application claims the benefit of Japanese Patent Application Number 2002-064796, filed on Mar. 11, 2002, by inventor Takahito Yamamiya, and also claims the benefit of Japanese Patent Application Number 2003-029006, filed on Feb. 6, 2003, by inventors Takahito Yamamiya and Akira Okuyama, both of which are to be assigned to Asahi Seiko Corp., Ltd. of Japan.

FIELD OF THE INVENTION

Various embodiments of the invention are related to an automatic dispensing device. More particularly, at least one embodiment of the invention relates to an automatic dispensing device for dispensing substantially flat enclosures made of a thin film or plastic material and goods therein. More specially, one embodiment of the invention relates to an automatic dispensing device for dispensing substantially flat goods, such as packaged cards.

DESCRIPTION OF RELATED ART

In U.S. Pat. No. 6,311,867 and Japanese Patent Publication 2001-118137, by Takahito Yamamiya, and assigned to Asahi Seiko Co., Ltd., automatic dispensing devices are disclosed for some types of flat goods, such as cards, envelops, packaged or wrapped cards, etc. These references disclose a dispensing device in which an uppermost card is pulled up by a suctioning device and then transported by a transporting device to be dispensed. For purposes of illustration, the term 'card' is used herein, but any other type of substantially flat good or enclosure with goods therein may also be used.

After the uppermost card is dispensed, the other remaining cards are lifted upwards in the dispensing bin and towards the suctioning device. When the next uppermost card is detected by a sensor, the upward lifting is stopped and the distance between the uppermost card and the suctioning device is driven to a predetermined distance.

The reason why the distance between the uppermost card and the suctioning device is kept at a predetermined distance is to prevent the next card from being dispensed at the same time as the uppermost card. When the next dispensing signal is received, the uppermost card is pulled by the suctioning device and is dispensed by the transporting device as previously described.

As temperature in the environment in which the dispensing machine operates changes, the air inside the flat enclosures expands or contracts the flat enclosure due to this change in temperature. Also, some cards or goods also tend to expand or contract as a result of temperature variations.

For example, in some implementations, the cards are enclosed in packages having a plurality of vent holes to prevent expanding or contracting of the package.

However, many packaged cards do not come in enclosures having vent holes and the enclosures are made of air-impermeable material. When the surrounding temperature of the dispensing machine increases, the air in the inside the non-venting enclosure expands and the enclosure and/or good, e.g., card, become thicker.

As a result of the increased thickness, the uppermost card is pushed up, and the distance between the card and the suctioning device becomes smaller than the predetermined right distance.

When the next dispensing signal is received, the uppermost card is dispensed as previously described.

However, the newest uppermost flat packaged card of increased thickness, is pushed upwards toward the suctioning device. Therefore, the distance between the newest uppermost packaged card and the suctioning device is smaller than the right distance.

Accordingly, the uppermost card is pulled upward by the suctioning device and then transported by the transporting device to be dispensed.

A sensor is located along the dispensing path which functions to prevent more than one card or good from being erroneously dispensed at one time. When an increase in temperature has caused the stack of packaged cards in the dispenser to expand, their distance to the suction device is greatly reduced. This causes the cards to be much closer to the transport device than is otherwise desired. This increased thickness of the packaged cards may cause two or more cards to be picked up by the transport device. When, instead of a single card, additional cards are also transported along the dispensing path, these additional cards are detected the sensor and the automatic dispensing machine is stopped. That is, when the sensor detects that more than one card or good is being erroneously dispensed the machine is stopped. Accordingly, this is a problem which reduces the capacity usage ratio of automatic dispensing machine.

This problem becomes more frequent as the coefficient of expansion of the packaged cards or goods becomes larger.

SUMMARY OF THE INVENTION

According to one embodiment of the invention an automatic dispensing machine of substantially flat packaged goods is provided which detects the over-dispensing of goods while accommodating for varying thickness of the substantially flat goods. The automatic dispensing machine includes a table which supports goods such as cards, a suctioning device which pulls the cards, a transporting device which transports the cards after they are pulled by the suctioning device, a position-control device which controls the distance between the uppermost card and the suctioning device. The position-control device is driven to increase the distance between the uppermost card and the suctioning device based on a dispensing signal. The distance between the uppermost card and the suctioning device is then decreased until a predetermined distance is reached.

In one embodiment of the invention, the uppermost packaged good, e.g., card, is pulled by the suctioning device and dispensed by the transporting device. Before the next card is dispensed, the distance between the card and the suctioning device is reset by increasing the distance between the next card and the suctioning device and then decreasing said distance until it reaches a predetermined distance. Accordingly, only the uppermost card is pulled by the suctioning device and dispensed by the transporting device.

The position-control device controls the distance between the uppermost packaged card and the suctioning device. In one implementation of the invention, when a dispensing signal is received, the position-control device first increases the distance between the uppermost card and the suctioning device. Then it decreases the distance between the uppermost card to be a predetermined or desired distance. The suctioning device then pulls up the uppermost card.

Before the next card is dispensed, the distance between the next card and the suctioning device is reset by first separating the next card or stack of cards from the suctioning device and then bringing them together to a predetermined distance. The next card may then be pulled by the suctioning device and dispensed. This process is continued for each packaged card dispensed.

According to one embodiment of the invention, the suctioning device and the transporting device are located in a fixed location while a moving device moves the table, which supports the packaged cards, to and from the suctioning device. Thus, the suctioning device and the transporting device remain fixed and the packaged cards are kept a predetermined distance by the moving device. Accordingly, the suctioning device and the transporting device, which have complicated mechanism, are not moved. This reduces accidents or problems with the dispensing device.

One embodiment of the invention provides a position-control device which includes a table to hold the stack of packaged cards or goods and a moving device for moving the table. The moving device serves to change the distance between the table, which is moved by the moving device, and the suctioning device to position the uppermost card or good to a desired distance. Accordingly, the distance between the uppermost card and the suctioning device is controlled by moving table up or down.

The moving device may also include an electric motor which is operated by the position-control device. The moving device controls the position of the stack of cards or packaged goods. The moving device may change the distance between the uppermost card or packaged good and the suctioning device by rotating direction of the motor in a forward direction or a reverse direction. In other words, the distance between the card and the suctioning device is changed by the rotating direction of the motor.

In one implementation of the invention, moving the card up or down requires moving the supporting table up or down. Thus, the suctioning device is located above the table and suctions the uppermost card. The transporting device then transports the suctioned card in the lateral direction to the dispensing point.

In one embodiment of the invention, the distance between the uppermost card and the suctioning device is controlled by the movement of the table. The table is first moved away from the suctioning device. Then the table is moved towards the suctioning device until it reaches the predetermined distance. That is, the supporting table is moved towards the suctioning device until the uppermost card reaches a predetermined or desired distance. The card is then pulled by the suctioning device and is transported sideways by the transporting device and dispensed.

The position-control device may also include a hoisting device which moves the table up and/or down. The position-control device may first operate the hoisting device to move table down, away from the suctioning device, and then move the table upwards to a predetermined position. The packaged cards or goods may be stacked up from top to bottom. When the table is moved downwards, the cards on the table are moved downwards, away from the suctioning device which is fixed. The table is then moved upwards towards the suctioning device and stopped when the uppermost card or good is at a predetermined distance from the suctioning device. The uppermost card is then pulled by the suctioning device and is dispensed by the transporting device.

In one embodiment of the invention, the hoisting device drives the table by rotating an electric motor. The distance between the uppermost card and the suctioning device is changed by operating the electric motor in the forward and/or reverse direction.

The position-control device may also include a position sensor which detects the position of the uppermost card on the table. When the cards are lifted by the supporting table, the uppermost card is detected by the sensor, and the table is stopped. The position of the uppermost card is controlled by the output of the sensor. Accordingly, the stopped position is the substantially the same every time. As a result, the distance between the uppermost card and the suctioning device is substantially the same every time.

DETAILED DESCRIPTION

In the following description numerous specific details are set forth in order to provide a thorough understanding of the invention. However, one skilled in the art would recognize that the invention may be practiced without these specific details. In other instances, well known methods, procedures, and/or components have not been described in detail so as not to unnecessarily obscure aspects of the invention.

In the following description, certain terminology is used to describe certain features of the invention. For instance, the terms "enclosure" and/or "packaging" are generically used to refer to any substantially flat bag, envelop, container, sack, wrapper, etc., which may be used to hold or secure one or more goods such as cards or other substantially flat items. The enclosure and/or package may be made from numerous materials, including resin, aluminum film, paper, plastic, etc. In some cases, the enclosure material is selected to be impermeable to air while in other implementations it may be permeable. Additionally, the term "card" includes a telephone card, pre-paid card, character card, smartcards and/or an IC card. Note that throughout this description, the terms "flat enclosure," "card", "packaged card", "packaged goods", "goods" and "items" may be interchangeably used to refer to substantially flat packages and/or goods such as cards, sheets, phone cards, as well as other goods that may be packaged in a substantially flat container or package.

Figure 1:
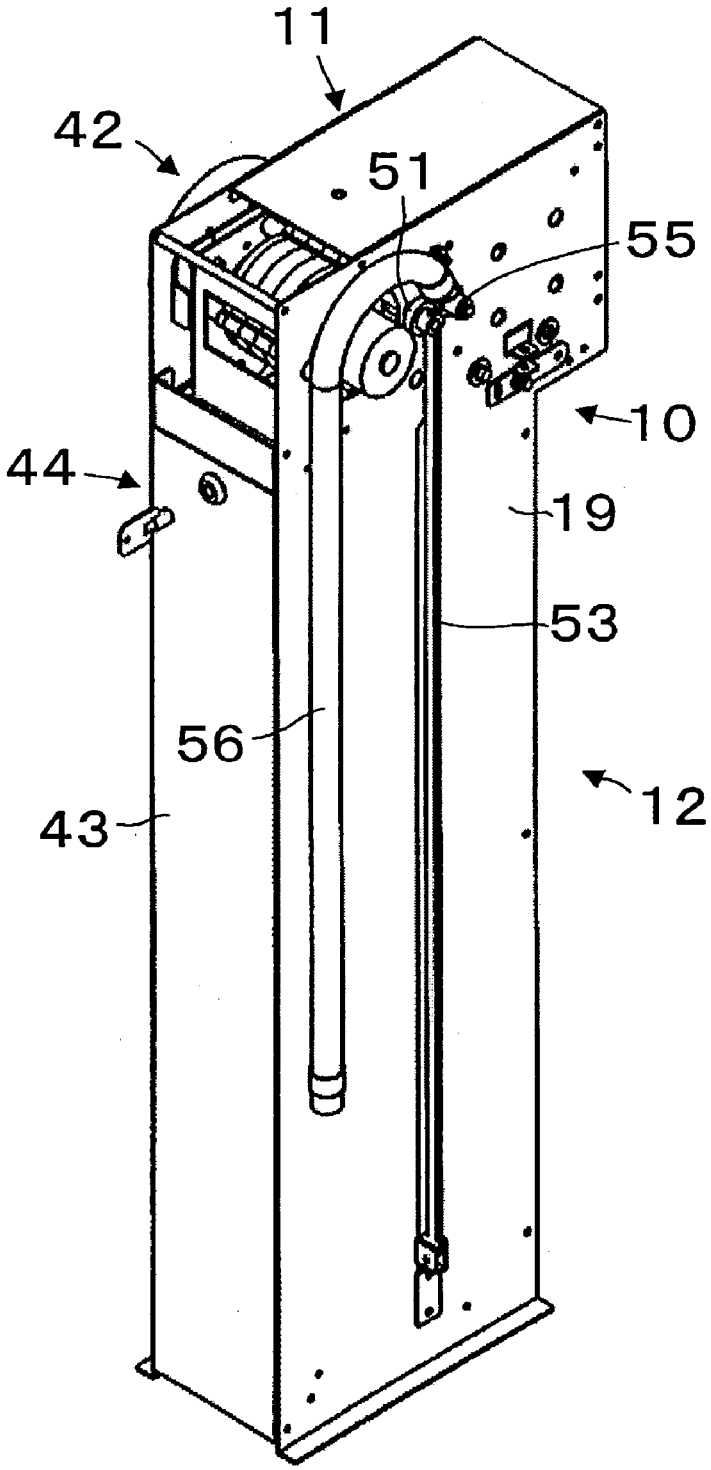
FIG. 1 is a perspective view of an automatic dispensing machine of the cards and goods according to one embodiment of the invention.
Figure 3:
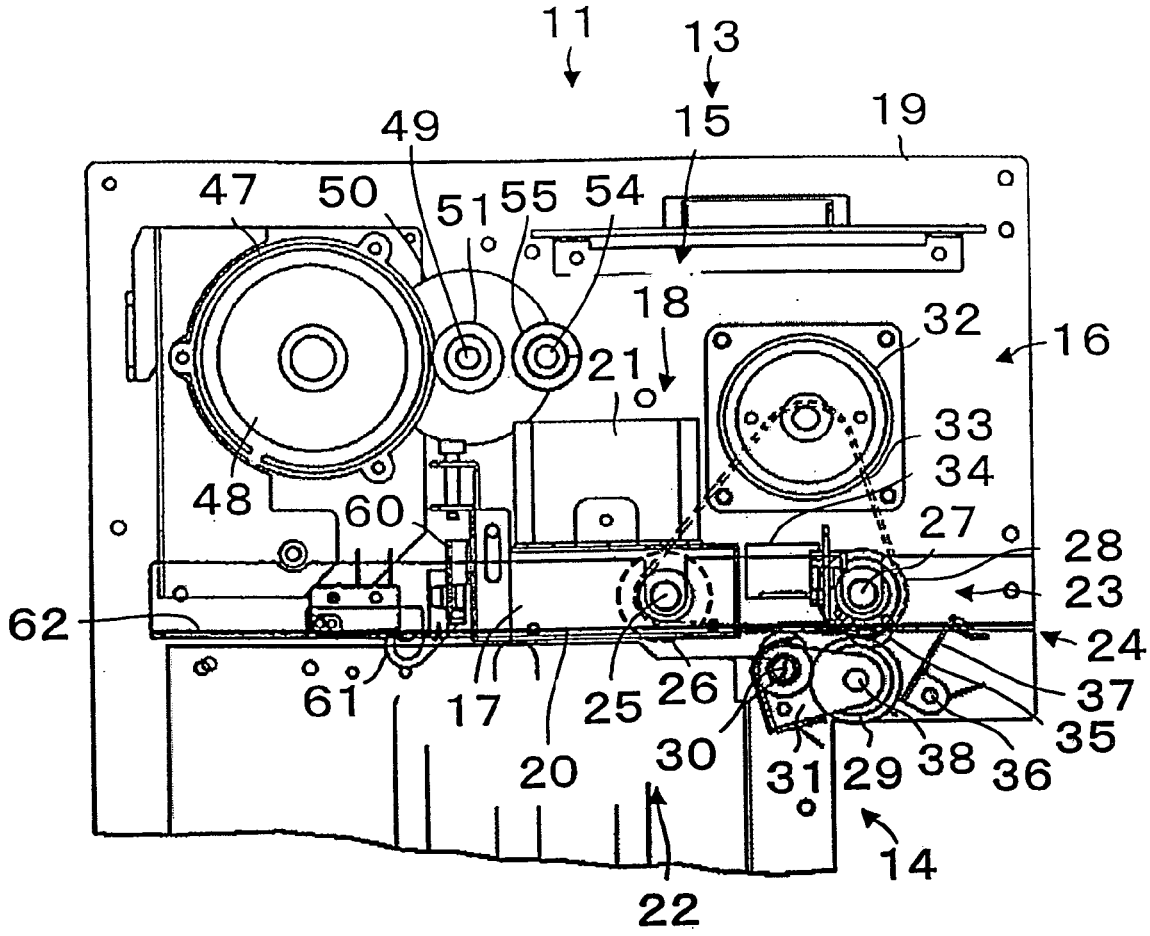
FIG. 3 is a cross sectional view of part of the automatic dispensing machine in FIG. 1.

FIG. 1 illustrates a perspective view of an automatic dispensing device according to one embodiment of the invention. The automatic dispensing device 10 for cards 1 (FIG. 8) includes a dispensing section 11 and a storing section 12. The dispensing section 11 includes a dispensing unit 13 and a duplicate-detecting device 14 as shown in FIG. 3. The dispensing unit 13 includes a suctioning device 15 and a transporting device 16.

Figure 8:
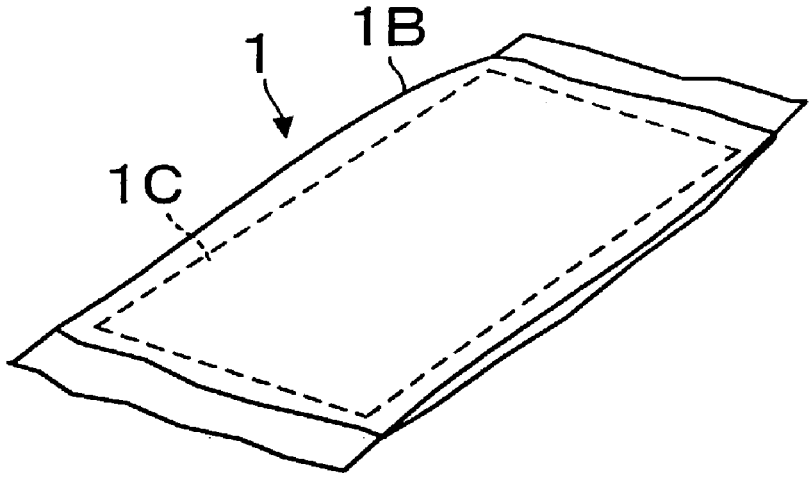
FIG. 8 illustrates a packaged card that may be dispensed by an automatic dispensing machine according to one embodiment of the invention.

The suctioning device 15 serves the function of pulling up the card 1 (FIG. 8). The suctioning device 15 includes a suction-generating device 18 and a guide tube 17 to channel the suction stream. In one embodiment of the invention, the guide tube 17 has a rectangular cross-section and is fixed to side frame 19. A suction opening 20 is defined by the lower end of guide tube 17 opposite the suction-generating device 18. When activated, the suction-generating device 18 causes a suction stream to be present at the opening 20. The suctioning power of the stream may be selected to be strong enough to lift the packaged card 1, and/or other goods being dispensed.

In one embodiment of the invention, the suction-generating device 18 includes an electric motor 21 with a fan that is fixed at the shaft of the electric motor 21 with the guide tube 17 coupled to the suctioning end of the electric motor 21. When the electric motor 21 rotates, the fan pulls air from the opening 20, creating an upward suctioning stream within the guide tube 17. In other embodiments of the invention, different suction-generating device may be employed without deviating from the invention. For example, the suction-generating device 18 may be a vacuum blower or an air-driven motor with a fan.

The transporting device 16 serves to transport the packaged card 1 (FIG. 8), or other substantially flat packaged good, that are pulled up by suctioning device 15 towards in lateral direction. In one embodiment of the invention, the transporting device 16 includes a first transporting device 22 which is located in the path of the suction stream in the guide tube 17 and a second transporting device 23 which is located adjacent to the guide tube 17.

The gripping surface of first transporting device 22 slightly protrudes downwards from suction opening 20 for transporting the card 1 which is pulled by to the suction opening 20 to second transporting device 23. In this embodiment, first transporting device 22 is a first roller 26 which is fixed on rotating shaft 25. In one embodiment of the invention, the rotating shaft 25 may be attached to the side wall of guiding tube 17.

The first roller 26 may be covered with a rubber for reducing slip of cards 1 and/or goods to be dispensed. In one embodiment of the invention, the first transporting device 22 may be replace by a belt 33 which moves towards the second transporting device 23.

The second transporting device 23 transports a card 1 (FIG. 8) from the first transporting device 22 towards a dispensing slot 24. In this embodiment, the second transporting device 23 includes a pair of rollers 28, 29. A second roller 28 is fixed on second rotating shaft 27 which is attached to side frame 19 and is located parallel to rotating shaft 25. The second roller 28 may be covered with a rubber for reducing slip of the card 1 or other goods to be dispensed.

A third roller 29 is located below the second roller 28. The third roller 29 is attached to shaft 38 which is supported by lever 31. Lever 31 is rotationally fixed to shaft 30 which is fixed to side frame 19. Lever 31 pivots by a spring (not shown) to bring the third roller 29 into contact with the second roller 28. A second electric motor 32 is located above the rotating shaft 25 and the second rotating shaft 27 and is fixed to side frame 19.

In one embodiment of the invention, belt 33 goes around a pulley on the output shaft of the second electric motor 32, and pulleys on the rotating shaft 25 and second rotating shaft 27. In FIG. 3, belt 33 turns in a counterclockwise direction in order to transport cards 1 or other goods toward the dispensing slot 24.

A dispense detection sensor 34 may be attached adjacent to the second roller 28. The dispense detection sensor 34 may include a contact trigger 35 located between the transporting passageways of card 1 or goods being dispensed.

When lever 31 is located at a predetermined position, a duplicate detection sensor 14 outputs a duplicate signal indicating that two or more cards 1 or goods are being erroneously dispensed. When two cards 1 or goods are pinched between the second roller 28 and the third roller 29 at the same time, lever 31 pivots in the clockwise direction further than usual. A sensor (not shown) detects that lever 31 has moved beyond it usual range and outputs a duplicate signal.

Shutter 37 is rotationally coupled to a second fixed shaft 36. The shutter 37 is located along the transporting passageway between the second transporting device 23 and the dispensing slot 24. Shutter 37 pivots in the counterclockwise direction by a spring shown in FIG. 3 and is located on the transporting passageway. When a card 1 moves on the transporting passageway, shutter 37 is pushed by card 1 and pivots in the clockwise direction, away from the transporting passageway. The card 1, or goods being dispensed, then reaches the dispensing opening 24.

Storing section 12 is used store cards 1 or other goods being dispensed. Storing section 12 includes a storing space 40 which extends vertically, a table 41 which supports and moves the cards 1 up and down, and a moving device 42 for move table 41 up and down. Storing space 40 is enclosed by side frames and extends vertically. The storing space is located below suctioning device 15 and is a rectangular column space. The lower section of lid 43 is pivotably attached to side frame 19. The upper section of lid 43 may be locked or secured to side frame 19 by a locking device 44. Lid 43 is detachable from side frame 19 and the cards 1 or goods may be stacked on table 41.

Table 41 is a rectangular plate and is located below guiding tube 17 in storing space 40 and can move towards or away from guiding tube 17. In other words, table 41 can move up and down. Cards 1 on table 41 are move to and from guiding tube 17 by the moving of table 41 up or down. Accordingly, table 41 can be changed or modified to other device for lifting and lowering the goods to be dispensed, without departing from the invention.

Moving device 42 includes a driving device 45 and a transmitting device 46. Driving device 45 is located in the proximity of the suctioning device 15. Driving device 45 includes a reducer 47 which is rotationally fixed to side frame 19, the third electric motor 48 which is fixed to reducer 47 and drives the reducer 47, a driving gear (not shown) which is fixed on the output shaft of reducer 47, rotating shaft 49 which is rotationally coupled to side frame 19, drive gear 50 which is engaged to the driving gear 50 and gear 51 which is fixed on the right end section of rotating shaft 49.

Driving device 45 serves the function of lifting and lowering table 41 to and from the suctioning device 15. Accordingly, driving device 45 can be changed to other mechanisms that serve the same function.

Figure 2:
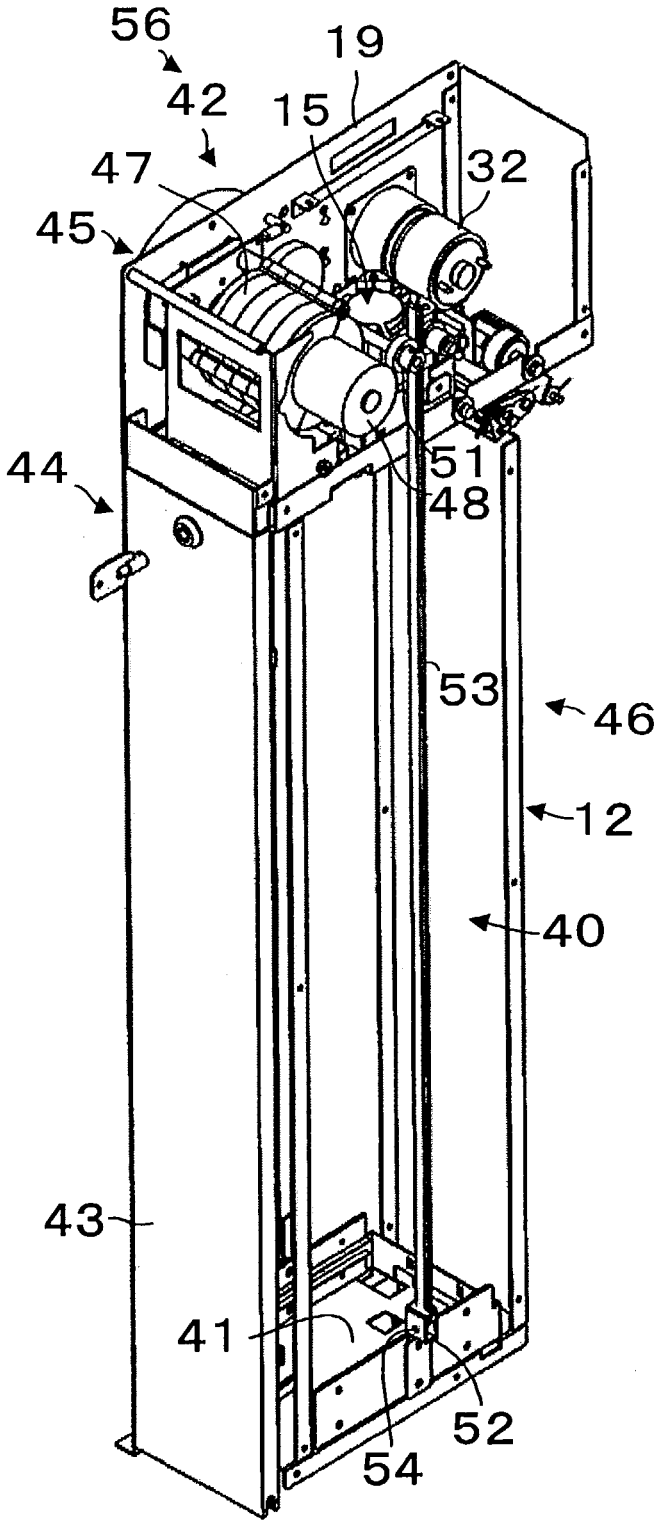
FIG. 2 is a perspective view of the automatic dispensing machine in FIG. 1 with a cover removed.

Transmitting device 46 is explained as shown in FIGS. 1 and 2. Lifting device 46 is located at the left and right sides of side frame 19 as the same as structure. The lower end of lifting supports 53 is attached at the sidewalls 52 of table 41 which protrude in the lateral direction away from table 41.

Lifting supports 53 maybe made of a flexible resin and can be bent. The middle of lifting support 53 engages with gear 51. The end of lifting support 53 is pushed by pinch roller 55 which rotates on fixed shaft 54 protruding from side frame 19. Accordingly, lifting support 53 has contact with gear 51. The end of lifting support 53 is inserted into a pipe 56 which is an inverted J and is fixed at the side of side frame 19. This pipe 56 serves to hide the lifting support and reduce the overall size of the dispensing mechanism.

In one embodiment of the invention, moving device 42 includes a hoisting device 57 to move the table 41 up and down. Moving device 42 serves the function of changing the distance between suctioning device 15 and cards 1 or good being dispensed.

In one embodiment of the invention, the driving device 45 and the lifting device 46 may be integrated. For example, a magnetic plate of linear motor are coupled to side frame 19, and the table 41 is connected with a coil plate to the linear motor.

Position sensor 60 is fixed to the upper side of baseboard 62, located horizontally between side frames 19. Position sensor 60 is located at the upper space of storing section 40, and includes a detector 61 located below suctioning opening 20. When contactor 61 is slightly pushed up by a card 1 or good being dispensed, position sensor 60 outputs a signal of "ON".

In this situation, contactor 61 is located at a predetermined position which is a predetermined distance between the uppermost card 1 and the suctioning opening 20. This distance is selected so that once the uppermost card 1 is dispensed the next card in the stack is not automatically pulled by the suctioning device 15. Accordingly, the attached position of position sensor 60 is variable. Position sensor 60 can be changed to a photo-electrical sensor etc. in other implementations. However, using a mechanical sensor with contactor 61, is inexpensive and reduces the need for periodic maintenance.

Figure 4:
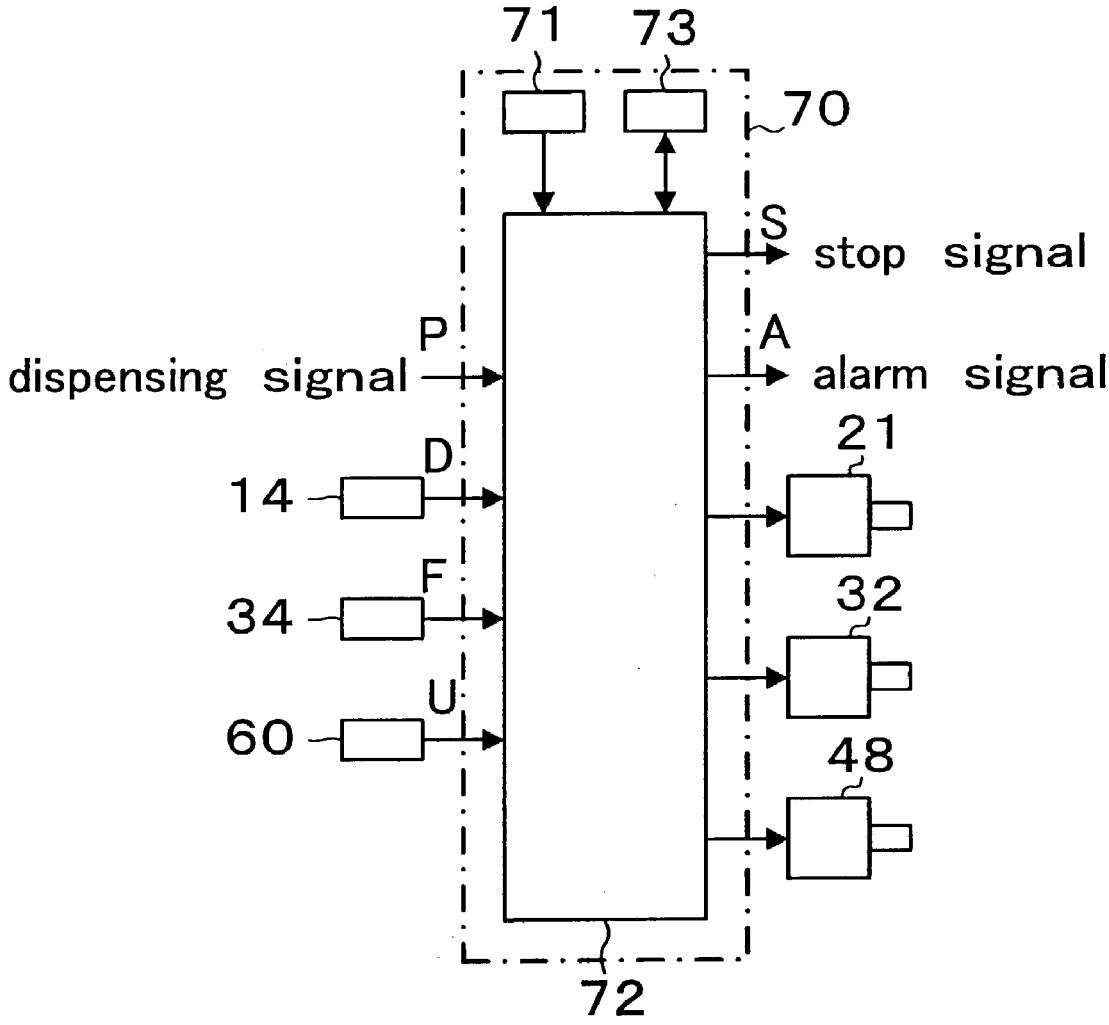
FIG. 4 is a block diagram illustrating a controller for an automatic dispensing machine according to one embodiment of the invention.

In one embodiment of the invention, the position-control device 63 may be implemented wholly or partially as software. FIG. 4 illustrates a controller for an automatic dispensing machine according to one embodiment of the invention. Main control circuit 70 is a microprocessor unit which processes instructions in of a program stored in ROM 71 and communicates with RAM 73. Accordingly, electric motor 21, second electric motor 32 and third electric motor 48 may all be controlled based on dispensing indication signal P, dispensing signal F from dispensing detecting sensor 34, duplicate signal D from duplicating sensor 14, upper position signal U from position sensor 60.

Figure 5:
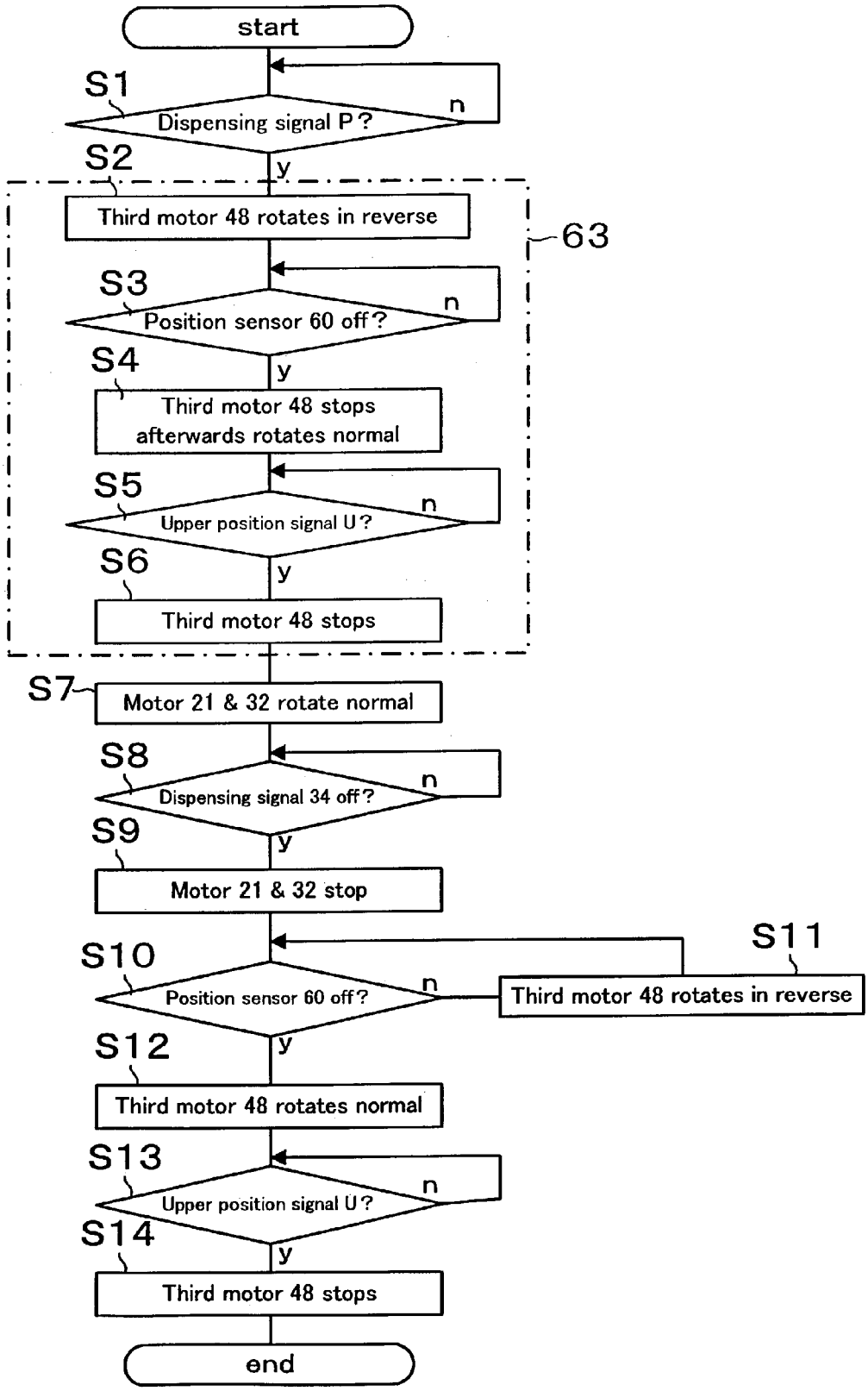
FIG. 5 is a flow chart illustrating the operation of an automatic dispensing machine according to one embodiment of the invention.

FIG. 5 is a flow chart illustrating the operation of an automatic dispensing machine controller according to one embodiment of the invention. In step 1, dispensing indication signal P from the vending machine is detected. When there is a dispensing indication signal P, the program goes to step S2, and the third motor 48 of moving device 42 is put in reverse. This causes gear 51 to rotate in the clockwise direction through reducer 47, drive gear 50 and rotating shaft 49, shown in FIG. 3.

Accordingly, lifting supports 53 are moved downwards, and the table 41 with the cards 1, or goods being dispensed, are also moved downwards. Contactor 61 which was pushed up by the uppermost card 1 moves downwards, and position sensor 60 outputs signal "OFF". In step S3, when the OFF signal is detected, the program goes to step S4, and the third motor 48 is stopped and then rotated in the forward direction.

The forward rotation of the third motor 48 causes gear 51 to rotate in the counterclockwise direction, relative to FIG. 3, and lifting support 53 moves upwards along with table 41. By the upward movement of table 41, the cards 1 are lifted upwards. When the uppermost card presses on or pushes contactor 61, position sensor 60 becomes "ON", and an upper position signal U is outputted.

In step S5, when upper position signal U is detected, the program goes to step S6, and the third motor 48 is stopped. At this time, the uppermost card 1 is at the predetermined or desired position. In this situation, the uppermost card 1, or packaged good to be dispensed, is in contact with at least part of the rim of suctioning opening 20.

In step S7, electric motor 21 of the suction-generating device 18 and the second motor 32 of the transporting device 16 are energized to rotate. By the rotation of motor 21, a fan is rotated which causes a suctioning stream at opening 20.

By the rotation of the second motor 32, roller 26 of first transporting device 22 and second roller 28 of second transporting device 23 are rotated, through belt 33, in the counterclockwise direction relative to FIG. 3. The uppermost card 1 is pulled up, by the suctioning stream, to suctioning opening 20. The lifted card 1 is transported towards the second transporting device 23 by roller 26.

The transported card 1 is moved between second roller 28 and third roller 29 of second transporting device 23 and is transported towards dispensing slot 24 by second roller 28. When the card 1 is located between second roller 28 and third roller 29, the third roller 29 moves downwards depending on the thickness of the card 1. Accordingly, lever 31 is rotated in the clockwise direction relative to FIG. 3.

When just a single card 1 has been lifted and transported, the pivot angle of lever 31 is smaller than a predetermined angle or threshold. When two or more cards have been erroneously lifted and transported, the pivot angle of lever 31 is larger than the predetermined angle or threshold. Accordingly, when the pivot angle is greater than a predetermined angle, this is considered duplicate dispensing, and duplicate signal D is outputted. Main control circuit 70 outputs stop dispensing signal S and alarm signal A based on the abnormal signal. By these signals, automatic dispensing device 10 is stopped, and an alarm is caused.

Also, when card 1 passes through the second transporting device 23, contact trigger 35 is pushed up, and dispensing sensor 24 outputs dispensing signal F. When card 1 passes through the second transporting device 23, contact trigger 35 moves downwards, and dispensing sensor 34 outputs the signal "OFF". In step S8, when the signal of "OFF" is detected, the program goes to step S9, and motors 21 and 32 are stopped. Accordingly, suction-generating device 18 is stopped, and the suctioning function of suctioning device 15 is stopped. Also, the rotations of first roller 26 and second roller 28 are stopped. In other words, the transporting function of transporting device 16 is stopped.

In step S10, signal of "OFF" from position sensor 60 is detected. Accordingly contactor 61, which is pushed up by the uppermost card 1, is detected. When position sensor 60 outputs upper position signal F, the program goes to step S11, and third motor 48 is reversed.

Accordingly, table 41 is moved downwards by lifting supports 53 as previously described. In other words, once the uppermost card 1 is lifted by the suction device 15, the remaining cards are moved downwards by the controller to prevent other cards from being erroneously pulled up by the suctioning device 15 and prevented erroneous dispensing.

Next in step S12, the third motor 48 rotates normal, and table 41 is lifted up and the program goes to step S13. In step S13, contactor 61 is pushed up by the uppermost card 1, position sensor 60 outputs upper position signal U, and when the upper position signal U is detected, and the program goes to step S14. In step S14, third motor 48 is stopped, and the uppermost card 1 is kept in the most desirable or predetermined distance from the suctioning device 15. The program goes into the standby position until the next dispense signal is received.

As has been previously described, from step S2 to step S6 correspond to the position-control device 63. In other words, position-control device 63 serves the function of decreasing the distance between a card 1 and the suctioning device 15, and, after a card has been lifted by the suctioning device 15, increasing the distance between the card stack and the suctioning device. When the position-control device 63 is controlled by software, it doesn't need new parts, and is therefore inexpensive. Also, position-control system includes the position-control device 63, table 41 and moving device 42.

Figure 6:
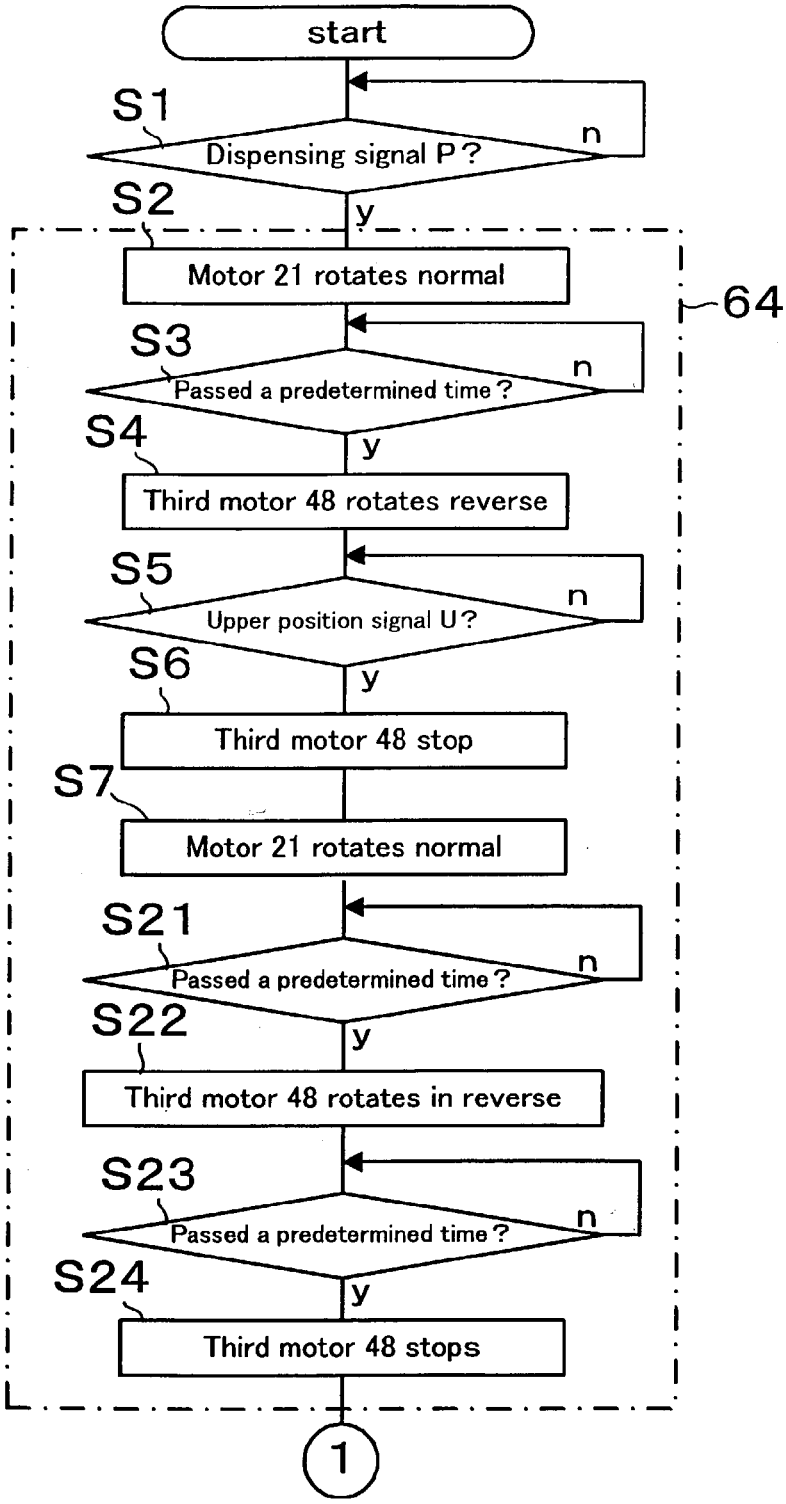
FIGS. 6 and 7 are flow charts illustrating the operation of an automatic dispensing machine according to a second embodiment of the invention.
Figure 7:
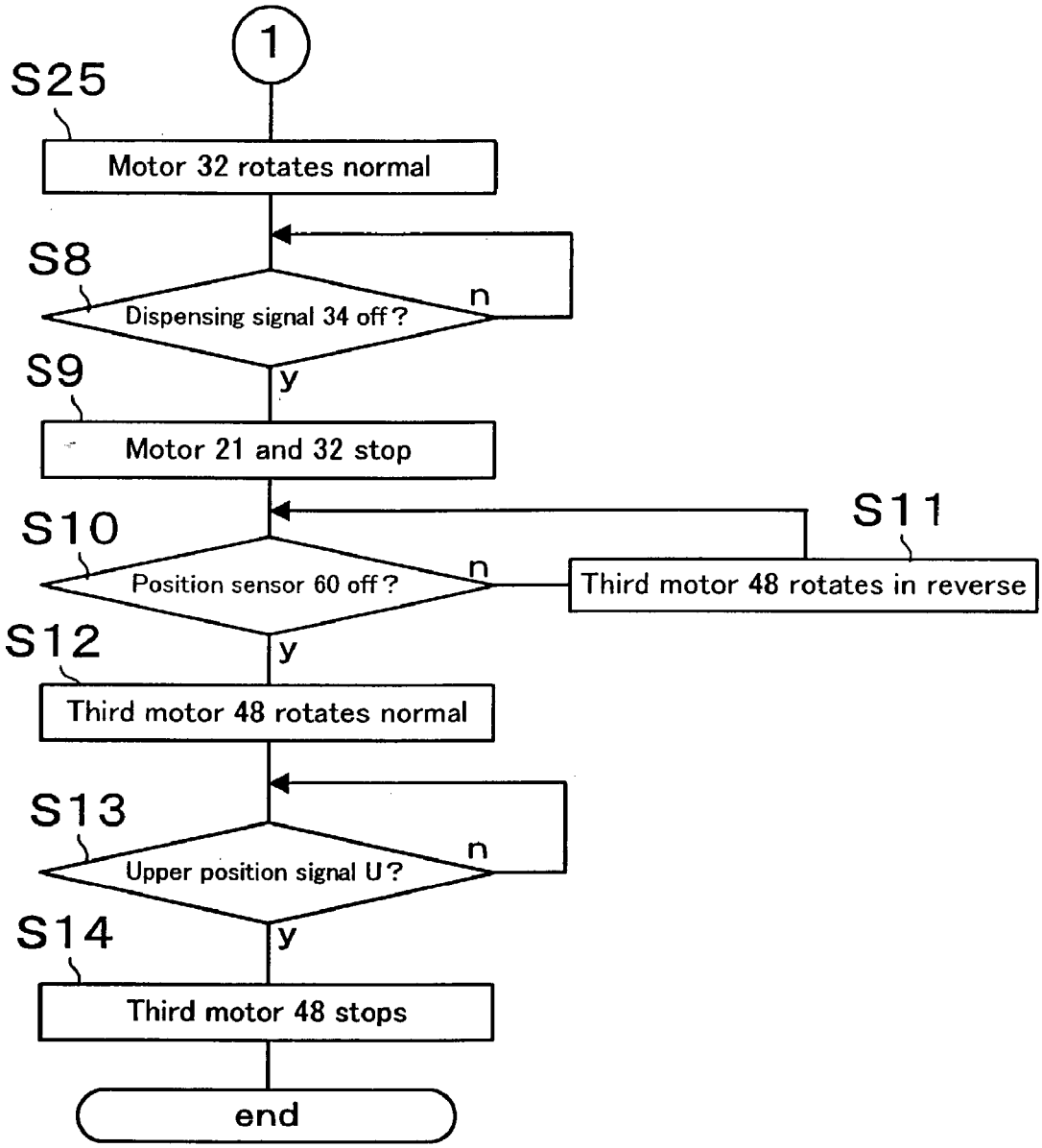

FIGS. 6 and 7 are flow charts illustrating the operation of an automatic dispensing machine according to a second embodiment of the invention. The second embodiment is of a second position adjusting system 64. Step S1 through to step S7 are the same as the first embodiment shown in FIG. 5 and described above. In addition, in step S5, the card 1 makes contact with the round rim of suctioning opening 20 at a slanted position. When the card 1 makes with the all round suctioning opening 20, the position of contactor 61 is triggered and the position sensor 60 outputs "ON".

Next, in step S21, the length of time to suction or lift the uppermost card 1 is clocked or determined. In step S22, the third motor 48 rotates in the reverse. Accordingly, gear 51 rotates in the clockwise direction, relative to FIG. 3, through reducer 47, drive gear 50 and rotating shaft 49.

Therefore, the remaining cards 1 on table 41 move downwards slowly because table 41 moves downwards slowly. By this downwards motion, cards 1 on table 41 are at a greater distance from card 1 which was pulled to be dispensed. This prevents extra cards from being pulled by the suctioning device 15. Accordingly the pulled card 1 is pulled continuously by suctioning device 15. The distance to which the remaining cards are lowered is a distance sufficient to prevent the suctioning device 15 from pulling additional cards from the stack.

In step S23, the length of time to dispense the uppermost card 1 is clocked. In step S24, the third motor 48 stops. Therefore, there is enough space for the pulled card 1 and the remaining card 1. In step S25, motor 32 rotates in the forward direction. Accordingly, card 1 is dispensed. Next, step S8 through to S14 operate as previously described. As previously described, steps S2 to step S24 correspond to a second position-control device 64. This embodiment is desirable because when the cards 1 are slanted, the uppermost card can be more easily pulled by suctioning device 15.

FIG. 8 illustrates a packaged card that may be dispensed by an automatic dispensing machine according to one embodiment of the invention. The packaging, wrapping, and/or enclosure material may be made from numerous materials, including resin, aluminum film, paper, plastic, etc. In some implementations the packaging material is selected to be impermeable to air. Note that in other implementations, the automatic dispensing machine may be used with other types of substantially flat packaging and/or enclosures. In yet other implementations, an automatic dispensing machine according to the invention may be used without any type of packaging, enclosure, and/or wrapper.

Accordingly, this present invention isn't limited by their words. While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications are possible. Those skilled, in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. An automatic dispensing machine of packaged cards comprising:

a movable table to support a plurality of stacked cards;

a stationary device to pull an uppermost card from the plurality stacked cards;

a transporting device to transport the uppermost pulled card from the suctioning device; and a position-control device communicatively coupled to the suctioning device and the transporting device, the position-control device operates the movement of the table and controls a distance between the plurality of stacked cards and the suctioning device, wherein the position-control device firstly increases the distance between the plurality of stacked cards and the suctioning device after the uppermost card has been pulled by the suctioning device, and then secondly decreases the distance until a predetermined distance is reached that prohibits a subsequent card in the plurality of stacked cards from being pulled by the suctioning device when the transporting device transports the uppermost pulled card.

2. The automatic dispensing machine of claim 1 further comprising:

a position sensor coupled to the position-control device, the position sensor to detect the distance between the plurality of stacked cards and the suctioning device and generate a signal when the predetermined distance is reached.

3. The automatic dispensing machine of claim 1, further comprising:

a moving device connected to the movable table and communicatively coupled to the position-control device, the moving device to move the table to and from the suctioning device.

4. The automatic dispensing machine of claim 3 wherein the moving device includes an electric motor controlled by the position-control device to lift and lower the table and increase the distance between the plurality of stacked and the suctioning device after a card has been pulled by the suctioning device, and then decrease the distance until the predetermined distance is reached.

5. The automatic dispensing machine of claim 1 wherein the predetermined distance is a distance sufficiently close to the suctioning device to allow the suctioning device to lift only the uppermost card.

6. The automatic dispensing machine of claim 1 wherein the plurality of stacked cards are packaged in air-tight packages.

7. The automatic dispensing machine of claim 1 wherein the suctioning device is halted before the position-control device starts decreasing the distance between the plurality of stacked cards and the suctioning device.

8. An automatic dispensing machine comprising:

a table to support a plurality of substantially flat items, the table is configured to move up and down;

a device with an opening located above the table, the suctioning device configured to provide enough suction to pull an uppermost flat item of the plurality of substantially flat items from the table;

a transporting device configured to transport a plurality of substantially flat item from the opening of a suctioning device in a lateral direction to the suctioning direction; and a position-control device which controls a distance between the substantially flat items and the suctioning device, the position-control device configured to increase the distance between the plurality of substantially flat items and the suctioning device based on a dispensing signal, and then decrease the distance until a predetermined distance is reached that is sufficient to prevent a flat item immediately beneath the uppermost flat item from being grasped by the suction of the suctioning device.

9. The automatic dispensing machine of claim 8 further comprising:

a hoisting device operatively connected to the table to lift the table up and down, the hoisting device communicatively coupled to the position-control device, wherein the position-control device causes the hoisting device to lower the table away from the opening of the suctioning device to increase the distance between the plurality of substantially flat items and the suctioning device, and lifts the table towards the opening of the suctioning device to decrease the distance between the plurality of substantially flat items and the suctioning device until the predetermined distance is reached.

10. The automatic dispensing machine of claim 9 wherein the hoisting device drives the table up and down by forward rotation and reverse rotation of an electric motor.

11. The automatic dispensing machine of claim 8 further comprising:

a position sensor communicatively coupled to the position-control device, the position sensor to detect the position of one of the plurality of substantially flat items which is closest to the opening of the suctioning device.

12. The automatic dispensing machine of claim 8 wherein the plurality of substantially flat items are cards.

13. The automatic dispensing machine of claim 8 wherein the suctioning device is halted before the position-control device starts decreasing the distance between the plurality of substantially flat items and the suctioning device.

14. A method of dispensing substantially flat goods comprising:

pulling a first substantially flat item, from a plurality of substantially flat items, upwards by a stationary suctioning device;

transporting the first substantially flat item to be dispensed;

withdrawing the remaining plurality of substantially flat items away from the suctioning device; and moving the remaining plurality of substantially flat items towards the suctioning device until a predetermined distance is reached that prohibits subsequent flat item in the plurality of substantially flat items from being pulled by the suctioning device when the first substantially flat item is transported from the plurality of substantially flat items.

15. The method of dispensing substantially flat goods of claim 14 wherein the plurality of substantially flat items are cards.

16. The method of dispensing substantially flat goods of claim 14 further comprising:

halting the suctioning device before moving the remaining plurality of substantially flat items towards the suctioning device.

17. An automatic dispensing system for dispensing stacked cards comprising a dispenser section having a frame;

a movable table assembly to support and move a stacked array of cards;

a stationary suction device mounted to the frame at a position above the movable table assembly to operatively engage an uppermost card from the stacked array of cards;

a transporting device to transport the uppermost card from the stacked array of cards including a gripping surface positioned adjacent and below the suction device;

a first position sensor for indicating when the uppermost card is operatively positioned at a predetermined distance from the suction device, the predetermined distance is sufficient to prevent a card immediately beneath the uppermost card from being grasped by suction force of the suction device when the uppermost card is transported off of the stacked array of cards by transporting device; and a position-control device operatively connected to the movable table assembly to move the stacked array of cards for operative suction contact of the uppermost card and subsequently to increase the distance between the sucked uppermost card and the card immediately beneath the uppermost card by the predetermined distance as indicated by the first position sensor.

18. The automatic dispensing system of claim 17 wherein the movable table assembly includes a flexible lifting support and a pipe for receiving and directing the lifting support in a direction parallel to a front edge of the frame.

19. The automatic dispensing system of claim 18 wherein the transporting device includes a first roller with a gripping surface and a pair of pinch rollers offset from the first roller for moving the card.

20. The automatic dispensing system of claim 19 wherein one pinch roller of the pair of pinch rollers is pivotally mounted and a second sensor is positioned to monitor the pivoted movement at a position that would indicate the simultaneous passing of more than one card between the pair of pinch rollers.

* * * * *